United States Patent [19]

Gowan, Jr.

[11] Patent Number: 4,878,999

[45] Date of Patent: Nov. 7, 1989

[54] NON-ALUM SIZING

[75] Inventor: John W. Gowan, Jr., Washington, D.C.

[73] Assignee: Westvaco Corporation, New York, N.Y.

[21] Appl. No.: 246,589

[22] Filed: Sep. 19, 1988

[51] Int. Cl.[4] ..... D21H 3/34

[52] U.S. Cl. ..... 162/164.6; 162/168.2; 162/168.3; 162/175; 162/180

[58] Field of Search ..... 162/164.6, 168.2, 168.3, 162/180, 175; 106/212, 218, 219, 226, 236, 238, 239

[56] References Cited

U.S. PATENT DOCUMENTS

| | | | |
|---|---|---|---|
| 3,096,232 | 7/1963 | Chapman | 162/180 |
| 3,526,524 | 9/1970 | Kulick | 106/238 |
| 3,790,537 | 2/1974 | Panzer et al. | 162/168.3 |
| 4,323,425 | 4/1982 | Dowthwaite et al. | 162/180 |
| 4,522,686 | 6/1985 | Dumas | 162/180 |

*Primary Examiner*—Peter Chin

*Attorney, Agent, or Firm*—Terry B. McDaniel; Richard L. Schmalz

[57] ABSTRACT

A process is disclosed for sizing cellulose fibers with rosin-base materials in the substantial absence of alum, which can be performed at a neutral pH. According to the process, a saponified fortified rosin is added to the cellulose fibers in the presence of a cationic starch and a cationic polymer of at least medium weight and medium charge.

7 Claims, No Drawings

NON-ALUM SIZING

BACKGROUND OF THE INVENTION (1) Field of the Invention

This invention relates to a process for sizing cellulose fiber products such as paper and paperboards with cellulose-nonreactive rosin-base materials, and more particularly to a process for sizing cellulose fiber products with pH neutral materials.

(2) Description of the Prior Art

Cellulose fiber products such as paper and paperboards are produced from an aqueous slurry, or furnish, of cellulose fibers containing sizing agents admixed therewith. These sizing agents generally comprise aqueous dispersions of rosin, especially fortified rosin, which is utilized to modify the surface of the paper to control water penetration. Such sizing is termed internal sizing and is an important step in the wet end operation of a paper machine.

Rosin, or rosin acid, itself has no affinity for cellulose fiber (i.e., rosin is cellulose-nonreactive) and must be anchored to the surface of the cellulose fiber with a cation. In the past, this has been done with the aluminum ion, normally derived from alum. The rosin acid size and aluminum ions do not react in solution but are co-deposited on the fiber surface, with the size held on the pulp fiber by electrostatic forces. At this point, the rosin acid size is not yet hydrophobic, but it becomes water-repellent after interaction with the alum in a subsequent heat curing step. The curing occurs when rosin size melts in the dryer section of the paper machine and the molten rosin acid spreads over the fiber surface and reacts with neighboring alum absorbed on it. The resulting aluminum rosinate is to a large extent responsible for the degree of water repellency of the paper product.

In the system described, the alum is effective as a precipitant only when the pH of the fibrous suspension is acid, typically around 4.5. This acidity has a detrimental corrosive action on paper making equipment, and results in the paper itself having an acid pH, which in the long term causes degradation of the paper. Moreover, the acid pH precludes the replacement of expensive titanium dioxide filler with less expensive but acid sensitive calcium carbonate.

It has been proposed in the art to use a cellulose-reactive size, such as a ketene dimer, which has an affinity for the cellulose in conjunction with a fortified rosin, as taught by Dumas in European Pat. Appln. No. 0 074 544, to achieve sizing at either acid or neutral pH either with or without alum. Of course, the alum system is preferred to involve both components in the sizing process.

Dumas, in U.S. Pat. No. 3,582,464, teaches the use of the acid anhydride form of rosin which, due to its affinity for cellulose, acts as a cellulose-reactive size material. This permits sizing in the absence of alum at acid or neutral pH, but the modified form of rosin is more expensive and, without rosin, the desired hydrophobicity is not achieved.

Also, it has been proposed in the art, particularly in U.S. Pat. Nos. 3,186,900, 3,248,353 and 3,966,654 to utilize cationic epichlorohydrin-containing resins as retention aids in the manufacture of paper. Although sizing has been shown with these systems at a neutral pH, the systems quite often involve the use of alum, nevertheless. The use of alum at a neutral pH is considered undesirable since it can result in the precipitation of aluminum hydroxide in the paper making equipment.

SUMMARY OF THE INVENTION

It is therefore an object of the present invention to size cellulose fiber products with rosin at a neutral pH.

It is a further object of the present invention to size cellulose fiber products with cellulose-nonreactive rosin in the absence of aluminum salts.

These and other objects of the present invention can be achieved by sizing utilizing a cationic polymer of at least medium molecular weight and at least medium charge, in the presence of a fortified, saponified rosin and a cationic starch filler, and in the substantial absence of alum.

DETAILED DESCRIPTION OF THE INVENTION

It has now been found that neutral sizing is possible with rosin in the absence of alum utilizing certain classes of cationic polymers. Cationic polymers can be ranked according to molecular weight and charge both, and to be useful according to the present invention, both the molecular weight and the charge must be at least medium. Medium molecular weight polymers have a molecular weight in the range of 15,000 to 30,000, and the preferred polymers are those with a high molecular weight, that is in excess of 30,000. In the same way, high charge polymers are also preferred.

High charge cationic polymers are considered to be those having greater than about 10% of the monomer units in a molecule being positively charged, while medium charge polymers have about 5–10% of the monomer units being charged. Low charge polymers have less than 5% charged units.

Generally these polymers will be added to the furnish in an amount of about 5–10 pounds per ton.

The preferred polymers of the present invention are polyamine sulfone polymers of the following general structural formula:

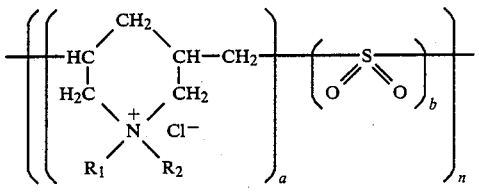

where $R_1$ and $R_2$ are $CH_3$.

These polymers are sold under the name PAS-H by Nittobo Company, Limited and have average molecular weights in excess of 50,000. They are strongly cationic high molecular weight polymers of the quaternary ammonium salt type whose cationic properties are maintained throughout the pH range. These polymers are soluble in water and have been suggested for use as flocculants and as fixing agents for paper sizing agents.

Another type of cationic resin useful according to the present invention is the polyacrylamide type. These resins are sold under the trademark PERCOL® by Allied Colloids and are utilized as flocculants. Among the Percols useful according to the present invention are medium molecular weight polymers such as PERCOL 778 and PERCOL 776.

The rosin component according to the present invention is a saponified, fortified rosin size.

"Fortified rosin" refers to a rosin which has been fortified with the reaction product of rosin and an unsaturated carboxylic acid or anhydride, such as maleic or fumaric. A representative saponified fortified rosin size is STAFOR 60 sold by Westvaco, containing 60% solids, which is liquid at room temperature. Fortified rosin sizes are well known to the art and are discussed, for example in U.S. Pat. No. 4,461,646. The rosin size materials are typically added to the furnish in an amount of about 5–10 pounds per ton.

The cationic starches used in the present invention are also well known in paper making, and are formed of a starch unit attached to a cationic moiety, such as a quaternary ammonium moiety. Representative cationic starches are disclosed in U.S. Pat. Nos. 3,674,725 and 4,066,495. One particular cationic starch useful according to the present invention is CATO 15, produced by National Starch and Chemical. Cationic starches are generally added to the furnish in an amount of 5–10 pounds per ton.

The following examples constitute specific embodiments of the invention, but are not to be construed as limitations thereon.

EXAMPLE 1

Saponified fortified rosin was used to provide hard sizing of paper at pH 8.0 using cationic polymers and cationic starch as described below. Handsheets were prepared according to TAPPI Standards T200OS-70 and T205OS-71. A 50/50 hardwood/softwood blend of baled pulp was used. The pulp was conditioned at 50% relative humidity for at least 48 hours before use. In this example, the cationic polymer, cationic starch and saponified fortified rosin were each added at a level of 10 pounds per ton to a 1% slurry of 75 seconds Williams slowness pulp. The handsheet samples were tested in accordance with the Hercules size test (HST), a standard test for measuring penetration of ink through paper. The data generated is set forth in Table I below. It is noted that this example was carried out in such a manner so as to retain maximum solids on the screen during paper formation.

TABLE I

| Retention Aid | M.W. | Charge Density | HST (seconds) |
|---|---|---|---|
| PERCOL 402 | low | high | 11 |
| PERCOL 776 | medium | medium | 144* |
| PAS-H | high | high | 1500 |

*The ring tester stopped at 144 due to leakage of ink around the test ring. Examination of the pad indicated no penetration through the sheet.

EXAMPLE 2

Handsheets were prepared according to the method of Example 1 at pH 8.0 utilizing both PAS-H and CATO 15 at a level of 10 pounds per ton. The rosin used was STAFOR 60 fortified saponified rosin size. For comparison, handsheets were prepared utilizing HERCON 48, an alkyl ketene dimer synthetic neutral size with a built-in retention aid, sold by Hercules Corp. The results of the HST tests are reported below in Table II:

TABLE II

| Size | HST |
|---|---|
| STAFOR 60 | 102.7 |

TABLE II-continued

| Size | HST |
|---|---|
| STAFOR 60 | 104.2 |
| HERCON 48 | 102.5 |

EXAMPLE 3

Handsheets were prepared generally as in Example 1, but in a range of pH values, utilizing both PAS-H and CATO 15 cationic starch at a level of 5 pounds per ton. As a comparison, the rosin used was STAFOR 35 a non-saponified 35% solids rosin dispersion in water. Handsheet samples were prepared at pH 4.5, 5.5, 6.5 and 8. For comparison, handsheets were prepared at pH 8 with HERCON 48 in addition to PAS-H and CATO 15 at a level of 5 pounds per ton. The results are reported below in Table III:

TABLE III

| Size | pH | HST |
|---|---|---|
| STAFOR 35 | 4.5 | 112.9 |
| STAFOR 35 | 5.5 | 57.6 |
| STAFOR 35 | 6.5 | 16.9 |
| STAFOR 35 | 8.0 | 4.5 |
| HERCON 48 | 8.0 | 154.5 |

The above results show that the cationic polymers of the present invention are far less effective with non-saponified rosin at pH 8.

EXAMPLE 4

Handsheets were generally prepared as in Example 2 utilizing PAS-H and CATO 15 at a level of 10 pounds per ton, with STAFOR 60 saponified rosin size. The handsheets were prepared at pH 4.5, 5.5, 6.5 and 8. For comparison, handsheets were prepared with HERCON 48 at pH 8 but without further additives. The results are reported below in Table IV:

TABLE IV

| Size | pH | HST |
|---|---|---|
| STAFOR 60 | 4.5 | 76.9 |
| STAFOR 60 | 6.5 | 59.5 |
| STAFOR 60 | 8.0 | 44.8 |
| HERCON 48 | 8.0 | 80.2 |

It is noted that the results of the HST at pH 8 is lower in Example 4 than in Example 2. This is thought to be due to differences in retention of the materials on the screen in the handsheet paper making process.

What is claimed is:

1. A process for the nonreactive sizing of cellulose fibers in the substantial absence of alum comprising adding to an aqueous furnish of cellulose fibers at approximately neutral pH conditions a sizing composition comprising cationic material consisting essentially of a cationic polymer characterized by a molecular weight of at least 15,000 and having at least 5% of the monomer units in said polymer exhibiting a positive charge, a cationic starch, and saponified fortified rosin.

2. The process of claim 1 wherein the molecular weight of said cationic polymer is in excess of about 30,000.

3. The process of claim 2 wherein said cationic polymer is a polyamine sulfone.

4. The process of claim 2 wherein said polymer is a polyacrylamide.

5. The process of claim 1 wherein said cationic starch and said cationic polymer are both added to said furnish at a level of about 5 to 10 pounds per ton.

6. The process of claim 1 wherein said cationic polymer has greater than 10% of the monomer units in a molecule exhibiting a positive charge.

7. The process of claim 3 wherein said polyamine sulfone is of the following general structural formula:

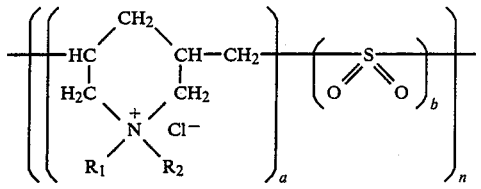

where $R_1$ and $R_2$ are $CH_3$ and a, b, and n are integers greater than 0 such that the average molecular weight is greater than 50,000.

* * * * *

UNITED STATES PATENT AND TRADEMARK OFFICE

CERTIFICATE OF CORRECTION

PATENT NO. : 4,878,999

DATED : November 7, 1989

INVENTOR(S) : John W. Gowan, Jr.

It is certified that error appears in the above-indentified patent and that said Letters Patent is hereby corrected as shown below:

On the title page: Item [63] insert --Related U.S. Application Data: Continuation-in-part of Ser. No. 830,992, Feb. 18, 1986, now abandoned--

On the cover page, under Abstract, line 3, delete "neutural" and substitute therefor --neutral--.

In column 1, after the title, insert --This application is a continuation-in-part of application Ser. No. 830,992, filed on February 18, 1986, now abandoned.--

Signed and Sealed this

Twenty-second Day of March, 1994

Bruce Lehman

*Attest:*

BRUCE LEHMAN

*Attesting Officer*

*Commissioner of Patents and Trademarks*